United States Patent [19]

Takashima

[11] Patent Number: 4,949,123

[45] Date of Patent: Aug. 14, 1990

[54] TONER SUPPLY DEVICE FOR A DEVELOPING APPARATUS

[75] Inventor: Masayuki Takashima, Yokohama, Japan

[73] Assignee: Ricoh Company, Ltd., Tokyo, Japan

[21] Appl. No.: 317,564

[22] Filed: Mar. 1, 1989

[30] Foreign Application Priority Data

Mar. 1, 1988 [JP] Japan ..... 63-25915[U]

[51] Int. Cl.[5] ..... G03G 15/08

[52] U.S. Cl. ..... 355/260; 222/DIG. 1

[58] Field of Search ..... 355/260, 245; 118/653; 222/DIG. 1; 141/311 R, 363–366, 383

[56] References Cited

U.S. PATENT DOCUMENTS 4,740,808 4/1988 Kasamura et al. ..... 355/260
4,814,821 3/1989 Sawayama et al. ..... 355/260
4,855,783 8/1989 Takashima et al. ..... 355/260 X

FOREIGN PATENT DOCUMENTS 59-61845 4/1984 Japan ..... 355/245

*Primary Examiner*—Joan H. Pendegrass
*Attorney, Agent, or Firm*—Oblon, Spivak, McClelland, Maier & Neustadt

[57] ABSTRACT

A toner supply device for supplying a toner to a developing apparatus of an electrophotographic copier or similar image recorder is implemented by a cylindrical toner tank mounted on the apparatus and a toner cartridge filled with a toner and removably loaded in the toner tank. A hook-like yieldable stop is fitted on the toner tank, while lugs having contiguous inclined surface are provided on the toner cartridge for urging the stop when the cartridge is inserted into the tank. The stop and lugs allow only a toner cartridge of exclusive kind associated with the image recorder to be inserted into the toner tank.

8 Claims, 3 Drawing Sheets

TONER SUPPLY DEVICE FOR A DEVELOPING APPARATUS

BACKGROUND OF THE INVENTION

The present invention relates to a developing apparatus applicable to various kinds of image recorders of the type using a two-component developer and, more particularly, to a device for supplying a toner to a developer stored in a developing apparatus from a toner cartridge which is removably loaded in a toner tank that is mounted on the developing apparatus.

In an electrophotographic copier, facsimile machine or similar image recorder, a toner contained in a developer which is stored in a developing apparatus is sequentially consumed as the developing apparatus is repeatedly operated. Therefore, a fresh toner has to be supplied to the developer in the developing apparatus every time a predetermined number of copies are produced or every time the toner density in the developer which is sensed is lowered to a predetermined value. A predominant implementation for the supply of fresh toner into a developing apparatus is a disposable toner cartridge which is filled with a fresh toner. The toner cartridge is removably loaded in a toner tank which is mounted on the developing apparatus, so that the fresh toner may be fed into the developing apparatus via a slot of the cartridge. When the toner in the toner cartridge is fully consumed, the empty cartridge is removed from the toner tank and discarded and, then, a new toner cartridge is loaded in the tank.

A prerequisite with such a disposable toner cartridge is that it be produced with a minimum of cost. Preferably, therefore, a toner cartridge should be commonly applicable to various types of developing apparatuses. On the other hand, some machines are operable with a particular kind of toner only and therefore needs an exclusive toner cartridge containing such a toner. With this kind of machine, it is necessary that a toner cartridge other than the exclusive toner cartridge be prevented from being inserted into a toner tank which is mounted on a developing apparatus of the machine. While some different approaches have heretofore been proposed to eliminate such inadvertent insertion of a toner cartridge of alien kind, they are complicated in construction and cannot fully eliminate the insertion of a toner cartridge of alien kind and, moreover, force a person to perform troublesome manipulations.

SUMMARY OF THE INVENTION

It is therefore an object of the present invention to provide a toner supply device for a developing apparatus which allows an exclusive toner cartridge to be accurately loaded on a toner tank which is mounted on the apparatus while surely preventing a toner cartridge other than the exclusive cartridge from being loaded.

It is another object of the present invention to provide a generally improved toner supply device for a developing apparatus.

In accordance with the present invention, a toner supply device for a developing apparatus on which a toner tank having a circular opening at one end for inserting a cylindrical toner cartridge is mounted comprises a stop provided on the toner tank adjacently to the circular opening and protruding into a toner cartridge insertion path defined in the toner tank to intefere with the toner cartridge being inserted, the stop resiliently retracting from the toner cartridge insertion path when urged outward in a radial direction of the toner tank from inside of the toner tank, and an urging member provided on the toner cartridge adjacently to one end of the toner cartridge and having an inclined surface for, when the toner cartridge is inserted into the toner tank, engaging with the stop to urge the stop outward from the inside of the toner tank.

Further, in accordance with the present invention, a toner cartridge for supplying a toner which is removably loaded in a cylindrical toner tank which has a circular opening at one end comprises a casing closed at both axial ends and provided with a slot for supplying the toner, a first lug provided on the casing adjacently to one of the axial ends of the casing and in alignment with the slot in an axial direction of the casing, the first lug having a first inclined surface, and a second lug provided on the one end of the casing and having a second inclined surface which is contiguous with the first inclined surface.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to a prior art toner supply device and a developing apparatus on which the toner supply device is mounted.

Figure 1:
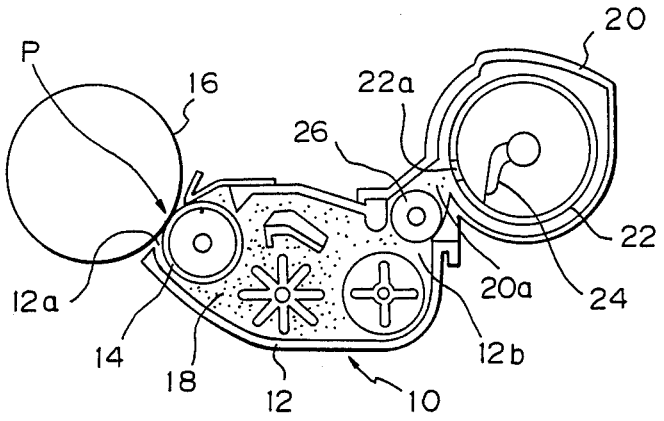
Fig. 1 PRIOR ART
FIG. 1 is a section of a developing apparatus of the type using a toner supply device which is implemented by a toner cartridge and a toner tank.

Referring to FIG. 1, a developing apparatus of the type using a two-component developer is shown and generally designated by the reference numeral 10. As shown, the developing apparatus 10 includes a casing 12 and a developing sleeve 14 which is disposed in the casing 12. The developing sleeve 14 is located in close proximity to a photoconductive drum 16 in such a manner as to face the drum 16 through an opening 12*a* which is formed in the casing 12. The sleeve 14 is rotatable to transport a developer 18 stored in the developing apparatus 10 to a developing position P where the developer 18 makes contact with the drum 16. The developer therefore develops a latent image which is electrostatically formed on the drum 16. The developer whose toner content has been reduced by the image development is returned to the developing apparatus 10 to be reused. A toner supply opening 12b is formed through an upper portion of the casing 12 remote from the developing sleeve 14. A toner tank 20 is mounted on the developing apparatus 10 with its toner supply opening 20a being aligned with the opening 12b of the casing 12. While various methods are available for supplying a toner into the toner tank 20, a predominant method is inserting a cylindrical toner cartridge 22 into the toner tank 20, as shown in the figure. Specifically, the toner tank 20 is formed with an opening 20b (FIG. 2) through its front end for accommodating the cylindrical toner cartridge 22. The toner cartridge 22 is inserted into the toner tank 20 via the opening 20a of the latter as indicated by an arrow 24 and then, rotated to bring its opening 22a into alignment with the opening 20a of the toner tank 20. An agitator 24 is accommodated in the toner cartridge 22 and rotatable to feed the toner from the cartridge 22 via the slot 22a. The toner coming out of the cartridge 22 is introduced into the developing apparatus 10 by way of the opening 20 of the toner tank 20, a toner supply roller 26, and the opening 12b of the casing 12.

When the toner cartridge 22 becomes empty with its toner fully consumed, it is removed from the toner tank 20 and discarded. It is therefore necessary to cut down the production cost of the toner cartridge as far as possible. Hence, a toner cartridge should preferably be commonly applicable to a plurality of different types of machines. However, some type of machine needs an exclusive toner cartridge storing a toner which is particular to the machine. Even in such a case, it is preferable that the cylindrical portion or body of the toner cartridge be provided with a common configuration.

Figure 2:
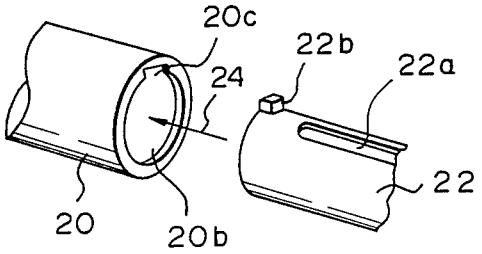
Fig. 2 PRIOR ART
FIG. 2 is a perspective view showing a prior art toner supply device.

The toner cartridge 22 is provided with the opening 22a for the supply of toner, as previously stated. As shown in FIG. 2, the edge of the toner tank 20 which defines the opening 20b is formed with a notch 20c in its upper end, while the toner cartridge 22 is provided with a lug 22b on its peripheral portion adjoining the end which will be inserted into the toner tank 20 first, i.e. front end. The lug 22b is aligned with the slot 22a in the axial direction of the toner cartridge 22 and so dimensioned as to be received in the notch 20c. To load the toner cartridge 22 in the toner tank 20, it is held by hand such that the opening 22a faces upward to prevent the toner from dropping therethrough and, then, it is moved deeper into the toner tank 20 with the lug 22b being aligned with the notch 20c.

The notch 20c and the lug 22b may each be provided with a special contour to prevent another toner cartridge having a lug which does not match with the notch 20c from being inserted in the toner tank 20. This may be successful in eliminating the previously discussed occurrence that a toner cartridge other than an exclusive cartridge is inadvertently loaded. However, considering the limited space available in a compact copier, it is impossible to increase the size of the lug 22b which has such a special contour, i.e., the lug 22b has to be configured as small as possible. Reducing the size of the lug 22b is undesirable because one might insert a toner cartridge other than the exclusive cartridge into the toner tank 20 by inclining the front end of its axis downward relative to the axis of the cylindrical toner tank 20. In such a condition, the developing apparatus would fail to perform accurate developing operations and therefore produce incomplete images and, moreover, the alien toner cartridge would damage not only itself but the toner tank 20 when removed from the tank 20.

Referring to FIG. 2, a toner supply device embodying the present invention is shown. The toner supply device, generally 30, is made up of a toner tank 32 and a toner cartridge 34 which is removably loaded in the toner tank 32. The toner tank 32 is provided with a circular opening 32a for the insertion of the toner cartridge 34. The edge of the toner tank 32 which defines the opening 32a is formed with a notch 32b in an upper portion thereof. On the other hand, the toner cartridge 34 is provided with an opening or slot 34a and a lug 35. The lug 35 is positioned such that when the slot 34a faces upward, the lug 35 protrudes upward from one end of the toner cartridge 34. The toner cartridge 34 cannot be inserted into the toner tank 32 unless the lug 35 of the former is aligned with the notch 32b of the latter, as with the prior art configuration.

Figure 4:
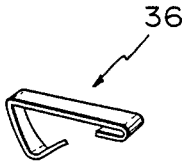
FIG. 4 is a perspective view of a stop which is included in the embodiment of FIG. 3.

In the illustrative embodiment, an opening 33a is formed through an upper portion of the toner tank 32 adjacently to the opening 32a. A hook-like stop 36 is implemented by a resilient plate of metal and fitted on the tank 32 in such a manner as to protrude into the tank 32 through the opening 33a. The configuration of the stop 36 is best shown in FIG. 4. Specifically, one end 36a of the stop 36 is fixedly retained by the bottom wall 33b of the notch 32b of the toner tank 32, while the hook-like other end 36b is passed through the opening 33a into the toner tank 32 to be located in a toner cartridge insertion path 38. The tip 36c of the end 36b of the snap 36 is bent obliquely upward toward the fixed end 36a. In this configuration, when the lower end 36d of the end 36b of the stop 36 is urged upward, the stop 36 resiliently retracts from the toner artridge insertion path 38.

Figure 3:
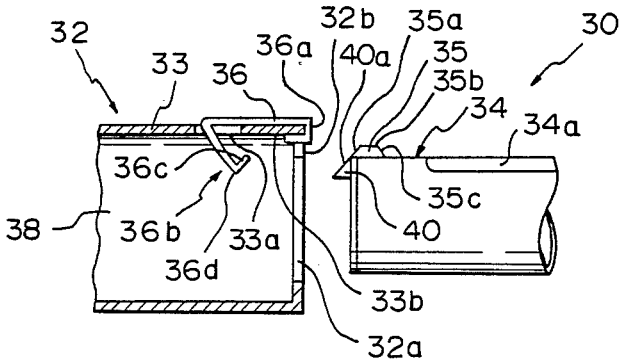
FIG. 3 is a fragmentary sectional side elevation of a toner supply device embodying the present invention.
Figure 5:
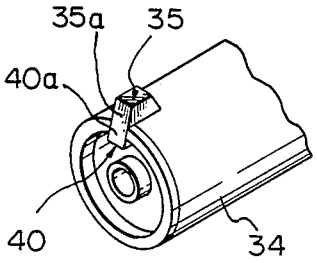
FIG. 5 is a perspective view of lugs which are also included in the embodiment of FIG. 3 and each being provided with an inclined surface.
Figure 6:
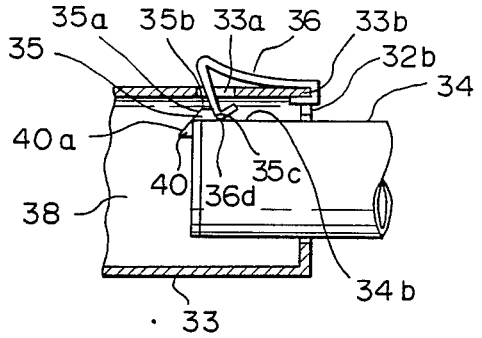
FIG. 6 is a sectional side elevation showing an exclusive toner cartridge and a toner tank in which the exclusive cartridge is inserted in accordance with the embodiment of FIG. 3.
Figure 7:
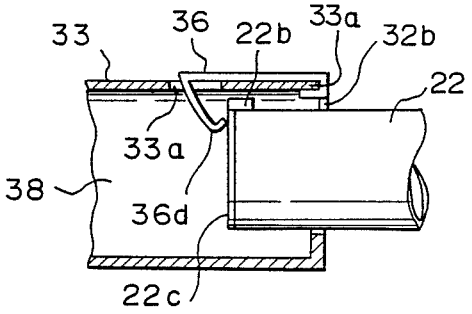
FIG. 7 is a view similar to FIG. 6, showing an ordinary toner cartridge, as distinguished from the exclusive cartridge, which is being inserted into the toner tank.

As shown in FIGS. 3 and 5, the toner cartridge 34 is provided with another lug 40 having an inclined surface 40a. This lug 40 extends forward or toward the toner tank 32 from the front end of the toner cartridge 34 and is contiguous with the lug 35 which extends upward from the cartridge 34. More specifically, the inclined surface 40a of the lug 40 merges into the inclined surface 35a of the lug 35. As the toner cartridge 34 is inserted into the toner tank 32 with its lug 35 aligned with the notch 32b of the circular opening 32 of the tank 32, the cartridge 34 will soon urge the lower end 36d of the stop 36 upward and the inclined surface 40a of its lug 40. When the toner cartridge 34 is moved deeper into the toner tank 32, the cartridge 34 urges the lower end 36d of the stop 36 further upward with the inclined surface 35a of its lug 35. As soon as a flat surface 35b of the lug 35 which follows the inclined surface 35a and another inclined surface 35c which follows the flat surface 35b sequentially move away from the stop 36, the stop 36 is brought into sliding contact with the periphery 34b of the casing of the cartridge 34, as shown in FIG. 6. In this position, the toner cartridge 34 is fully accommodated in the toner tank 32. Assume that a person inadvertently inserts into the toner tank 32 the toner cartridge 22 shown in FIG. 2 which is not provided with any of the lug 40 having the inclined surface 40a and the lug 35 having the inclined surface 35a. Then, as shown in FIG. 7, the lug 22b of the toner cartridge 22 abuts against and is intercepted by the lower end 36d of the stop 36 although it may successfuly move away from the notch 32b.

Figure 8:
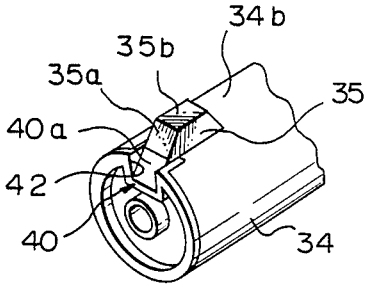
FIG. 8 is a perspective view showing a modification to the embodiment shown in FIG. 3.

FIG. 8 shows a modification to the above-described embodiment. In FIGS. 3 and 5, the inclined surface 40*a* of the lug 40 is shown as protruding from the front end of the toner cartridge 32. In the alternative configuration shown in FIG. 8, the casing periphery 34*b* of the toner cartridge 34 adjacent to the front end is provided with a recess 42 in its upper portion, and the lug 40 having the inclined surface 40*a* is fixedly received in the recess 42.

In summary, it will be seen that the present invention provides a toner supply device which, when applied to a developing device of the type using an exclusive toner cartridge, surely prevents any other kind of toner cartridge from being loaded in a toner tank. In addition, since a toner cartridge of alien kind is identified in the initial stage of insertion, a person is freed from extra operations otherwise needed to replace the alien cartridge with the exclusive cartridge.

Various modifications will become possible for those skilled in the art after receiving the teachings of the present disclosure without departing from the scope thereof.

What is claimed is:

1. A toner supply device for a developing apparatus on which a toner tank having a circular opening at one end for inserting a cylindrical toner cartridge is mounted, comprising:

stop means provided on said toner tank adjacently to said circular opening and protruding into a toner cartridge insertion path defined in said toner tank to interfere with said toner cartridge being inserted, said stop means resiliently retracting from said toner cartridge insertion path when urged outward in a radial direction of said toner tank from inside of said toner tank; and urging means provided on said toner cartridge adjacently to one end of said toner cartridge and having an inclined surface for, when said toner cartridge is inserted into said toner tank, engaging with said stop to urge said stop outward from the inside of said toner tank.

2. A device as claimed in claim 1, wherein said stop means comprises a resilient member having one end which is fixedly retained by said toner tank in close proximity to said opening and the other end which has hook-like configuration and protrudes into said toner cartridge insertion path.

3. A device as claimed in claim 2, wherein said resilient member comprises a resilient plate of metal.

4. A device as claimed in claim 1, wherein said urging means comprises a first lug protruding outward from outer periphery of said toner cartridge in close proximity to said one end and having a first inclined surface which constitutes a part of said inclined surface for urging said stop means away from said toner cartridge insertion path, and a second lug extending forward from said one end of said toner cartridge and having a second inclined surface which forms the other part of said inclined surface.

5. A device as claimed in claim 4, wherein said first inclined surface and said second inclined surface are contiguous with each other.

6. A device as claimed in claim 5, wherein said second lug is fixedly received in a recess which is formed in the outer periphery of said toner cartridge adjacently to said one end.

7. A toner cartridge for supplying a toner which is removably loaded in a cylindrical toner tank which has a circular openng at one end, comprising:

a casing closed at both axial ends and provided with a slot for supplying the toner;

a first lug provided on said casing adjacently to one of said axial ends of said casing and in alignment with said slot in an axial direction of said casing, said first lug having a first inclined surface; and a second lug provided on said one end of said casing and having a second inclined surface which is contiguous with said first inclined surface.

8. A toner cartridge as claimed in claim 7, wherein said second lug is fixedly received in a recess which is formed in said casing adjacently to said one end of said casing.

* * * * *